United States Patent [19]

McNeil

[11] Patent Number: 4,693,037

[45] Date of Patent: Sep. 15, 1987

[54] MULTISTAGE FINISHING DEVICE AND METHOD

[75] Inventor: Gary L. McNeil, Allegan, Mich.

[73] Assignee: Roto-Finish Company, Inc., Kalamazoo, Mich.

[21] Appl. No.: 833,203

[22] Filed: Feb. 25, 1986

[51] Int. Cl.[4] ..... B24B 31/06

[52] U.S. Cl. ..... 51/163.2; 51/313; 366/108; 134/117; 134/132

[58] Field of Search ..... 51/163.2, 163.1, 313; 134/132, 117; 366/108, 110, 114, 138

[56] References Cited

U.S. PATENT DOCUMENTS

| | | | |
|---|---|---|---|
| 2,292,775 | 12/1966 | White | 134/132 |
| 2,882,024 | 4/1959 | Behrens et al. . | |
| 3,336,701 | 8/1967 | Moore | 51/163.1 |
| 3,607,478 | 9/1971 | Henninges | 366/219 |
| 4,035,960 | 7/1977 | Balz | 51/163.1 |
| 4,201,017 | 5/1980 | Davenport | 51/163.2 |
| 4,428,161 | 1/1984 | Walther | 51/163.2 |

FOREIGN PATENT DOCUMENTS

| | | | |
|---|---|---|---|
| 1562232 | 3/1980 | United Kingdom . | |
| 139427 | 1/1961 | U.S.S.R. | 51/163.1 |
| 271328 | 9/1970 | U.S.S.R. | 51/163.2 |
| 294715 | 3/1971 | U.S.S.R. | 51/163.2 |
| 500043 | 3/1976 | U.S.S.R. | 51/163.1 |

*Primary Examiner*—Frederick R. Schmidt
*Attorney, Agent, or Firm*—Gordon W. Hueschen

[57] ABSTRACT

A vibratory finishing machine for the surface finishing of workpieces comprising an essentially spiral trough, having a plurality of channels in side-by-side relationship, resiliently mounted for vibration and tilted with respect to the horizontal; such a spiral trough which is employed as a finishing chamber by attachment to a resiliently-mounted vibratory structure of a vibratory finishing machine; and a method and apparatus for vibratorily finishing a workpiece by subjecting it to a surface finishing medium in such a trough, having liquid finishing medium in only lower sections thereof and having solid finishing medium in an outer channel of said trough, are disclosed.

49 Claims, 9 Drawing Figures

18
58
62
58
58
32
34
34
34
34
66
68
30
34

46
18
100
32
59
58
32
64
66
5.
5.
1 2 3 4 5 6
62
56
48
82
80
50
54
6.
44
38
40
42
54
50
52
54
50
36
50
6.

MULTISTAGE FINISHING DEVICE AND METHOD

FIELD OF INVENTION

Finishing machines, especially vibratory or vibrogyratory finishing machines; finishing chambers uniquely adapted for employment in such finishing machines; multistage finishing machines and multistage finishing machine chambers; method of surface finishing including cleaning of a part or workpiece, especially in a multistage operation.

BACKGROUND OF THE INVENTION AND PRIOR ART

The prior art is replete with finishing machines, including vibratory (the generic term) and vibrogyratory (a species thereof) finishing machines, of innumerable types and descriptions, most of which are adapted for the single stage surface finishing of a part of workpiece therein. When more than a single operation has been required or desired, this has ordinarily been effected by carrying out successive operations in a single machine, with the necessity of emptying the machine and replenishing the finishing medium therein with another type of finishing medium, or of using a series of machines, with necessary transfer from one machine to another and possible storage of partially finished parts or workpieces in between. A combination of fluid and solid finishing media has been employed by utilization of solid ceramic, plastic, or like abrasive media and at the same time spraying the finishing media and parts with various aqueous or chemical fluid surface finishing media, such as solvent wash, water rinse, rust preventive or inhibitor solutions, and the like, but such procedure does not provide the total surface finishing of a part or workpiece in the same manner as a succession of surface treatments of various types, particularly when it is desired or required that the part or workpiece have a highly polished surface which is entirely free of contaminants such as oils or greases and be completely dry. Proposals have been made for the successive finishing of parts or workpieces in a so-called horizontal Spiratron TM with baffles for transferring parts or workpieces from one section thereof to another section, containing different media and/or sprays, upon rotation of a finishing chamber, as in U.S. Pat. Nos. 3,074,068 and 3,073,080, but such devices are expensive and have not proved acceptable in practice. Neither have the multistage so called helical or vertical Spiratrons TM of U.S. Pat. No. Re. 27,084, for the same reasons. At the present stage of the development of this art, there is no satisfactory, economical, and practical vibratory or vibrogyratory finishing machine available to industry wherein parts or workpieces may be treated successively in a series of steps involving a plurality of solid or fluid surface treating media without the necessity of separating the partially-finished parts at an intermediate stage and transferring them to the next stage and perhaps storing them in between stages, and wherein parts or workpieces can be introduced into the vibratory finishing device and subjected to a plurality of surface treatments as desired, from beginning to end, and then exited from the finishing machine in a highly polished, uncontaminated, and dry state, ready for immediate use in applications requiring the most stringent specifications and tolerances, such as apply to roller bearings or the like. Neither has any suitable finishing trough or chamber been available for the employment in, on or in conjunction with a vibratory finishing machine for the accomplishment of such objectives. It is apparent that the finishing art, and industry in general which is highly reliant upon the same, would be greatly benefitted by the provision and availability of a new and improved finishing machine particularly adapted to multistage surface finishing operations, especially such a machine wherein the various stages or cycles of the surface finishing operation could be carried out in a single machine in a single pass or continuous manner, such as in a single continuous trough, especially such a trough which would be non-linear in nature to avoid inevitable conflicts with space and floor area limitations, as well as a novel method for the multistage surface finishing of parts or workpieces which would avoid the shortcomings of the prior art and present day equipment and practice.

OBJECTS OF THE INVENTION

It is an object of the present invention, inter alia, to provide a novel finishing trough for a vibratory finishing machine, which is especially adaptable to a multistage surface finishing operation which may involve both fluid and solid surface treatment media. It is another object of the invention to provide such a finishing trough which is spiral in nature and which may be provided either as a part of original equipment or as an insert to existing vibratory equipment. A further object of the invention is the provision of such a trough which is angled, tilted, or slanted from the horizontal, so as to permit subjection of a part of workpiece to be finished to be exposed to liquid finishing medium at one section or portion of the trough and to dry solid finishing medium at another section or portion of the finishing trough, or to no medium at all at another section of the trough, all of which (depending upon the sequence and arrangement of the types of finishing media employed and intervening spacing in the trough) permits the multistage surface finishing of parts or workpieces in an unprecedentedly rapid, economic, simplified, and facile manner. Another object of the invention is to provide such a spiral trough which may be used as an insert to existing vibratory equipment, and a still further object of the invention is the provision of a new, improved, and simplified multistage surface-finishing apparatus and method whereby a part or workpiece to be finished may be introduced into the process, be treated in a plurality of stages, and emerge from the process in a highly polished, uncontaminated, dry condition. Further objects will become apparent hereinafter, and still other objects of the invention will be obvious to one skilled in the art.

SUMMARY OF THE INVENTION

The invention, then, inter alia, comprises the following:

A vibratory finishing machine for the surface finishing of workpieces comprising an essentially spiral trough, having a plurality of channels in side-by-side relationship, resiliently mounted for vibration and tilted with respect to the horizontal so as to provide a high side and a low side to said sprial trough; such a machine comprising means for introduction of unfinished parts into one channel of said spiral trough and means for exit of finished parts from another channel of said spiral trough; such a machine wherein said means for introducing unfinished parts is arranged to introduce unfinished parts into an interior channel of said spiral trough; such a machine wherein said means for exit of finished parts is arranged for exit of finished parts from an outside channel of said trough; such a machine comprising means for the introduction of liquid finishing medium into one or more channels of said spiral trough; such a machine comprising means for the introduction of liquid finishing medium into a plurality of channels of said spiral trough; such a machine comprising liquid level control means in one or more channels of said spiral trough for controlling the liquid level therein at the low side thereof; such a machine comprising a plurality of liquid level control means in a plurality of said channels of said spiral trough; such a machine comprising tilting means for tilting said spiral trough with respect to the horizontal; such a machine wherein said tilting means is fixed; such a machine wherein said tilting means is variable; such a machine wherein said spiral trough comprises resilient elastomeric material; such a machine wherein said spiral trough is constructed of resilient elastomeric material; such a machine comprising a barrier strip between adjacent channels of said spiral trough for isolation of the contents of one channel from the contents of the adjacent channel; such a machine comprising means for introducing solid particulate finishing medium into a channel of said spiral trough; such a machine comprising pickup means for removing solid particulate finishing medium from a channel of said spiral trough at a point in said spiral trough after the point at which it is introduced; such a machine comprising means for returning said medium to a channel of said spiral trough; such a machine including heating means for drying said medium before returning same to a channel of said spiral trough; such a machine comprising means for the introduction of one kind of finishing medium into one channel of said trough and means for the introduction of a different kind of finishing medium into a different channel of said trough; and such a machine comprising means for the introduction of solid finishing medium into one channel of said trough and means for the introduction of liquid finishing medium into a different channel of said trough.

Moreover, also an essentially spiral trough, having a plurality of channels therein in side-by-side relationship, preferably comprising a resilient elastomeric material, mounted on support means, and employed as a finishing chamber of a vibratory finishing machine by attachment to a resiliently-mounted vibratory structure thereof, said trough being at an angle with the horizontal; such a trough constructed of resilient elastomeric material; such a trough mounted in, on, or to the said structure of said vibratory finishing machine; such a trough mounted to the existing finishing chamber of a finishing machine having a central cylindrical column and to the central cylindrical column thereof; such a trough wherein said spiral trough and said support means have a circular opening central thereof to essentially correspond with the central cylindrical column of said finishing machine; such a trough wherein said spiral trough and said support means are annular in nature and of dimensions essentially corresponding to the cylindrical center column of said finishing machine and to the existing finishing chamber thereof; such trough in any case being at an angle with respect to the horizontal.

Additionally, and importantly, a method for vibratorily surface finishing a workpiece which comprises the steps of subjecting a workpiece to the action of a surface finishing medium in an essentially spiral troughlike finishing chamber, having a plurality of channels in side-by-side relationship, which is resiliently mounted for vibration at an angle with respect to the horizontal, thereby to provide lower and upper sections of said troughlike chamber and the channels thereof, comprising the steps of:

introducing a workpiece to be surface finished into at least one of said channels, introducing a surface finishing medium into said channel, maintaining the medium level in said channel so that the lower section of said channel contains said medium, and so that the upper section of said channel is essentially free thereof, imparting vibrations to said channel to cause said workpiece to be surface finished by said surface finishing medium in said medium-containing lower section of said channel, and to cause said workpiece to progress upwardly into said upper section of said channel which does not contain surface finishing medium; such a method including the steps of:

introducing a second surface finishing medium into a second channel of said trough, maintaining the medium level in said second channel so that the lower section of said channel contains said medium, and so that the upper section of said channel is essentially free thereof, vibratorily causing said workpiece to progress into the section of said second channel of said trough containing said second surface finishing medium, and imparting vibrations to said second channel to cause said workpiece to be surface finished by said second surface finishing medium and then to cause said workpiece to progress upwardly into said upper section of said second channel which does not contain surface finishing medium; such a method wherein one of said first and second finishing media is a liquid finishing medium; such a method wherein one of said first and second finishing media is a solid finishing medium; and such a method wherein the other of said first and second surface finishing media is a solid surface finishing medium.

Also, a method for vibratorily surface finishing a workpiece which comprises the steps of subjecting a workpiece to the action of a surface finishing medium in an essentially spiral trough finishing chamber having a plurality of channels in side-by-side relationship, which is resiliently mounted for vibration at an angle with respect to the horizontal, thereby to provide lower and upper portions of said trough and the channels thereof, comprising the steps of:

introducing a workpiece to be finished into at least one channel of said spiral trough, introducing a liquid surface finishing medium into at least that channel of said spiral trough, maintaining the liquid level in said channel of said trough so that the lower portion of said channel contains said liquid and so that the upper portion of said channel is essentially free thereof, introducing a solid surface finishing medium into another channel of said spiral trough, imparting vibrations to said spiral trough to cause said workpiece to be surface finished by said liquid surface finishing medium in said liquid-containing lower portion of said channel, and to cause said workpiece to travel upwardly into an upper portion of said channel which does not contain said liquid surface finishing medium, and to cause said workpiece then to progress into said channel of said spiral trough containing said solid surface finishing medium, and to cause said workpiece then to be surface finished by said solid surface finishing medium, and then recovering said surface-finished workpiece; such a method when conducted in a batchwise, intermittent, or continuous manner; such a method wherein a plurality of different liquid surface finishing media are introduced into a plurality of channels and said workpiece is subjected to vibratory action in the presence in each of said liquid surface finishing media; such a method wherein said workpiece is caused to be dried between exposures to said different liquid media by vibratorily causing said part to traverse the upper essentially dry section of at least one channel; such a method comprising the step of controlling the liquid level in said channels so as to ensure an essentially dry section of said channels at upper portions thereof; such a method wherein different liquid surface finishing media are introduced into alternate channels and the intermediate channel is left dry, thereby to cause residual liquid to drain from said workpiece and maintain said different liquid surface finishing media as separate entities; such a method wherein solid particulate finishing material is introduced into said spiral trough, used in finishing a workpiece, and removed from said spiral trough and new or recycled solid particulate finishing material introduced into said spiral trough for continuing the process with fresh finishing material; such a method wherein finishing material removed from said process is subjected to heating to dry the same and is then recycled back into the process; such a method wherein the dwell time of a workpiece within a particular section or channel of the spiral trough is increased by retarding the forward movement or precession thereof in a particular channel or section thereof; such a method wherein workpieces are vibratorily subjected to solvent surface treatment, rinse surface treatment, and rust inhibitor treatment in selected channels of said spiral trough and are then subjected to surface drying and polishing with cobmeal in a further channel of said spiral trough, whereafter the cobmeal is vacuum removed from said workpieces and the cleaned, dried, and polished workpieces recovered; such a method wherein the liquid surface-finishing medium to which a workpiece is subjected at a lower portion of one channel of said spiral trough is removed by vibratorily causing the workpiece to travel along the upper portion of said channel before being subjected to a further surface finishing medium in another channel; and such a method wherein one liquid surface treating medium is removed from said workpiece before subjecting it to a second liquid surface treating medium by vibratorily causing the workpiece to travel along an intermediate channel between a channel containing a first liquid surface treating medium and a channel containing a second liquid surface treating medium which intermediate channel is essentially devoid of any liquid surface treating medium; and such a method wherein said solid surface finishing medium is contained in a channel of said trough which is the last channel in the direction of travel of said workpiece within said spiral trough.

DESCRIPTION OF THE DRAWINGS

A more complete understanding of the invention may be had by reference to the following detailed description when taken in conjunction with the accompanying drawings, wherein.

DETAILED DESCRIPTION OF THE INVENTION

Figure 1:
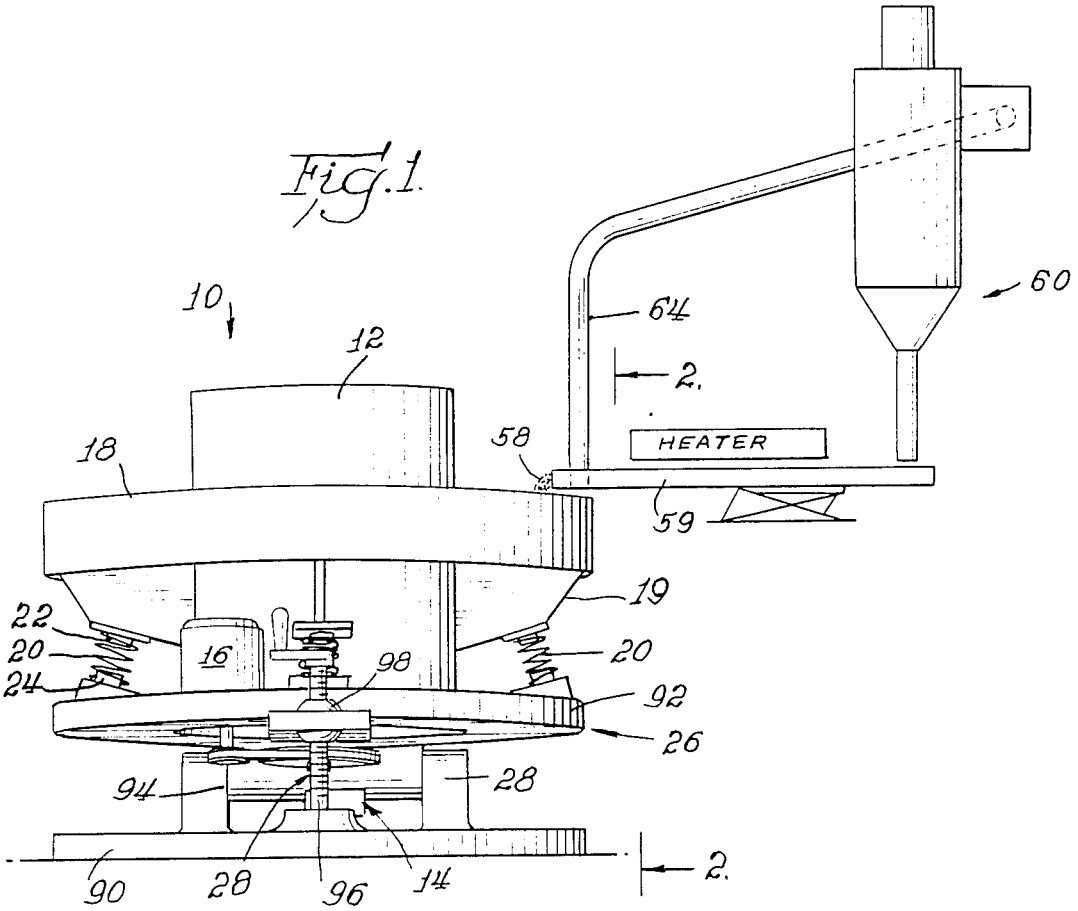
FIG. 1 is an elevational view of a vibratory finishing machine according to the invention comprising drying and recirculation means for the final drying and polishing medium employed.
Figure 2:
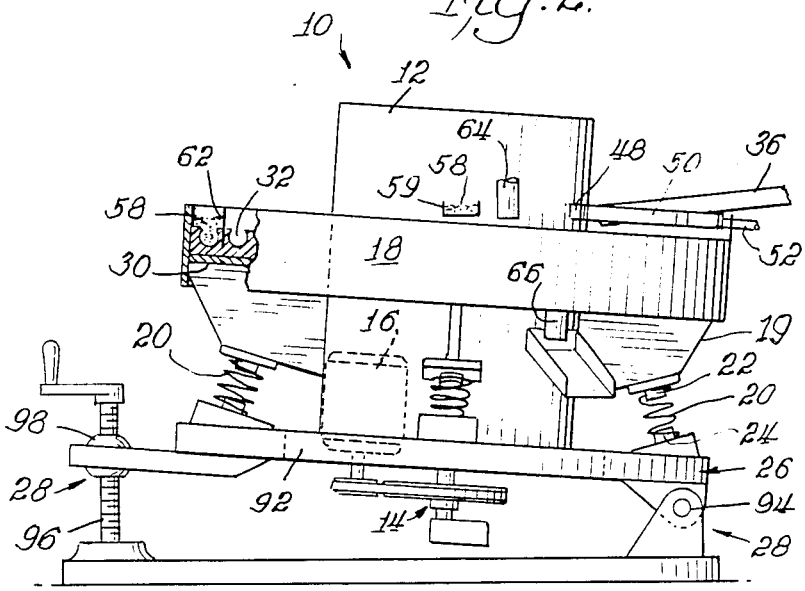
FIG. 2 is a side elevational view of the vibratory finishing machine, showing the entrance and exit for workpieces as well as the exit and entrance for the final drying and polishing medium, taken along the line 2—2 of FIG. 1.

Referring now to the drawings, and particularly to FIGS. 1 and 2 thereof, a vibratory or vibrogyratory finishing machine according to the invention is shown at 10. Cylindrical housing 12 for vibratory mechanism 14 having a central shaft and at least one eccentric weight driven for rotation by universal motor 16 mounted to central cylindrical housing 12 vibrates ring or tub 18, resiliently mounted through resilient means such as an elastomeric block or, as shown, helical springs 20, held in place by standard means such as bosses 22 on bracket or gusset 19 supporting the ring or tub 18 and bosses 24 on base frame 26. Ring or tub 18, including its central cylindrical housing 12, and its vibratory mechanism 14 comprising a central shaft with one or a plurality of eccentric weights at opposite ends thereof is mounted on base frame 26 comprising a slantable or tiltable sub base 92 in the form of an annular ring or suspension of the ring or tub 18 with its central column 12 centrally thereof joined to base 90 by heavy hinge arrangement 94 and at the side opposite hinge 94 by adjusting means comprising screw adjustment 96 threaded through a nut held in swivel 98 mounted on an arm attached to sub base 92, such sub base with its arm and the hinge and the adjusting means together comprising slanting means 28. This slanting means 28 has the capacity for raising or lowering one or more springs 20 and, correspondingly, the side or sides of the ring or tub 18 supported thereby.

Interior of tub or ring 18 is located annular or doughnut-shaped plate 30, which is attached to cylindrical housing 12 and tub or ring 18 by welding or other suitable means. Located upon top plate 30 and supported thereby is spiral trough 32 having a plurality of channels in side-by-side relationship, produced from polyurethane or other suitable elastomer by the employment of a spiral coil as a mold or otherwise as more fully disclosed hereinafter. This trough 32, when tilted, in effect becomes a plurality of troughs with built-in connecting means. Workpieces, in the form of roller bearings 34 or the like, when present in said spiral trough, advance about the vibratory trough 32 by vibratory action, when the direction of rotation of the vibratory means is opposite to the intended path of their travel, and at a rate dependent upon the intensity of the force factor imparted by vibratory means 14 as a result of the rate of revolution of the vibratory means 14 and the size of the eccentric weight or weights on the central shaft thereof and their out of phase relationship, as is well known in the art. (See for example U.S. Pat. No. 4,461,122.) Liquids in trough 32 do not advance by vibratory action because of tilting of the trough from the horizontal to provide dry areas in the higher portion of the spiral trough to prevent the liquids from mixing and because of siphoning means which prevent the level of liquid in the spiral trough 32 from becoming greater than desired, as will be further described hereinafter. The various liquids provided in the spiral trough 32 have the effect of a sonic cleaner upon workpieces 34 as they advance through the selected system created within the spiral trough, and are finally dried in the last cycle by drying medium in the form of cobmeal 58 or the like before exiting from the device and the particular finishing system contained therein.

Workpieces 34 enter the device 10 by means of chute 36 (see FIG. 4) and are guided by chute 36 into the innermost channel or turn 38 of trough 32, at such point normally comprising considerable cutting or machine oil and usual surface contaminants. In this manner workpieces 34 are guided or transported into the innermost channel or turn of trough 32, from whence they commence their journey outwardly through the system and through the spiral trough containing the various liquid and solid materials preselected for the surface finishing, e.g., cleaning, polishing, and drying, of the particular workpieces 34 involved.

Figure 3:
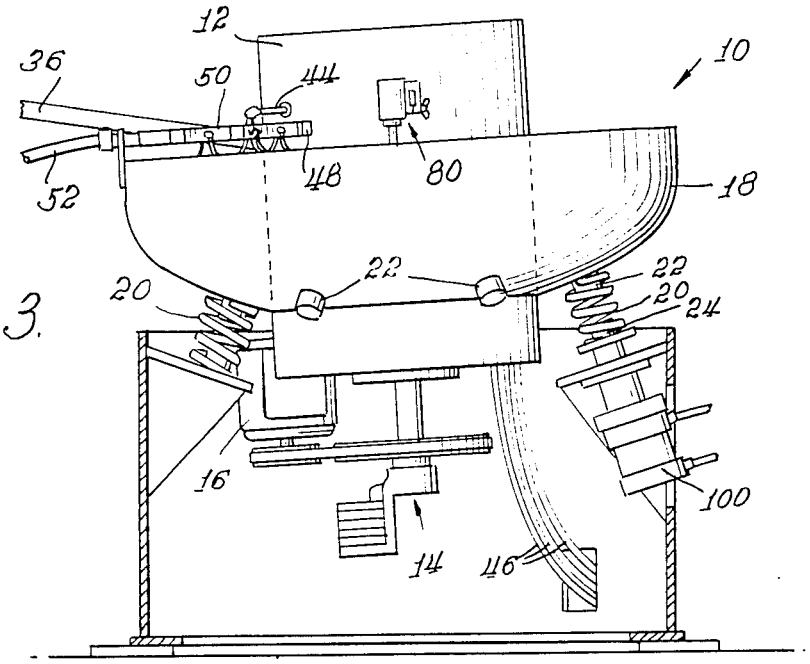
FIG. 3 is a side elevational view of a modified form showing power tilting means and conventional bowl-type finishing chamber construction.
Figure 6:
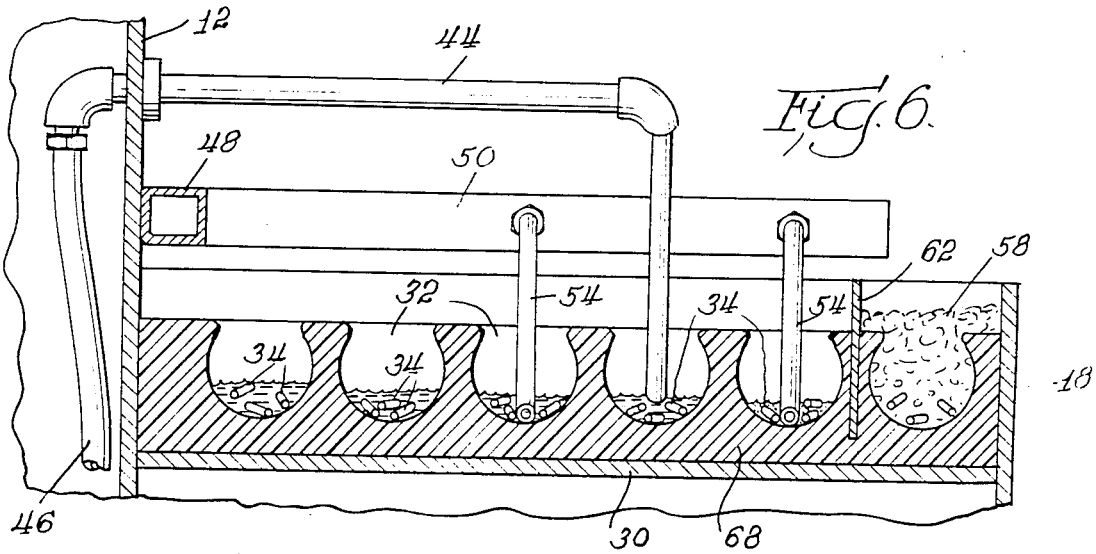
FIG. 6 is a section taken along line 6—6 of FIG. 4.
Figure 4:
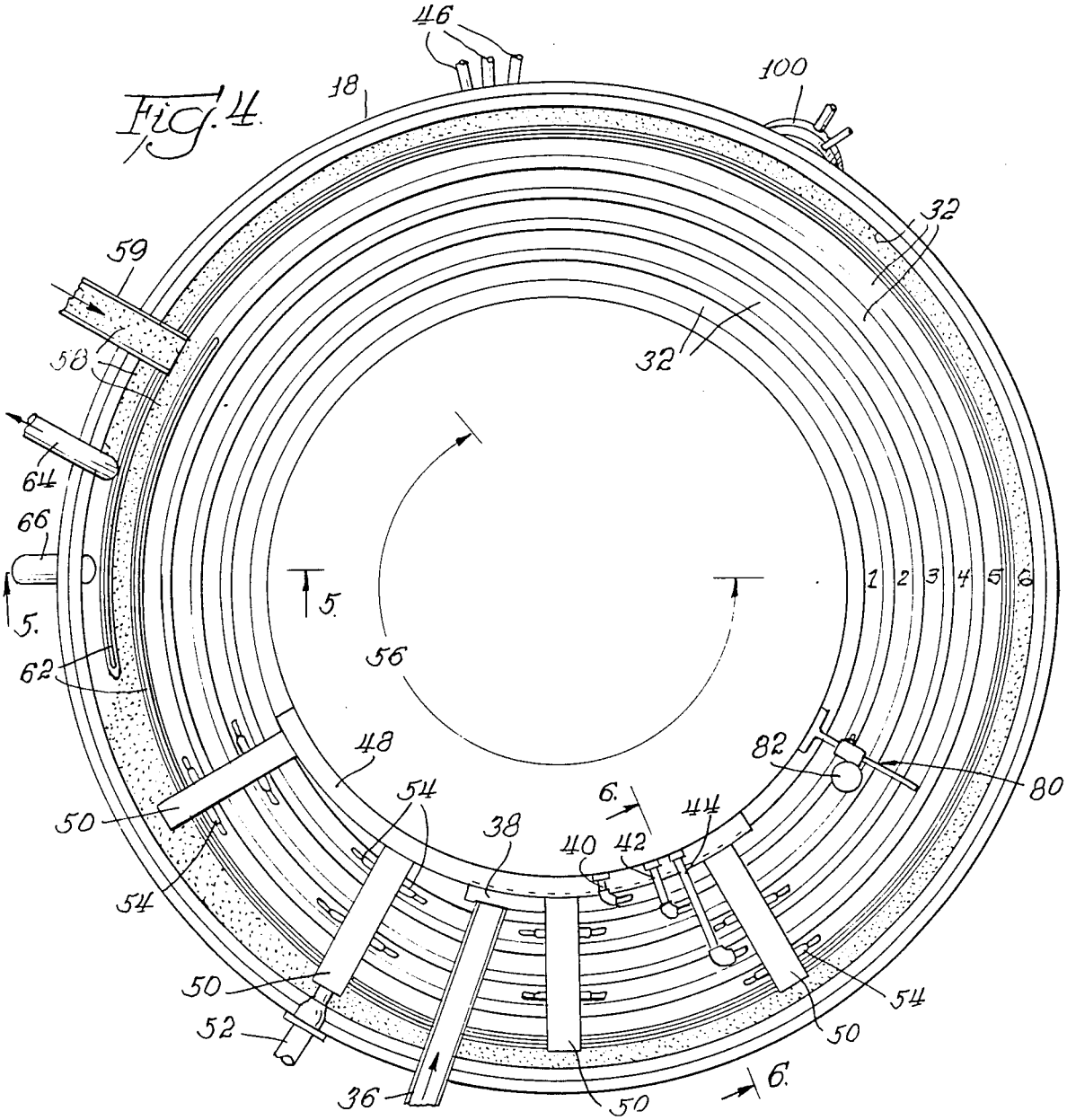
FIG. 4 is a top view of the finishing machine of FIG. 3 showing the spiral trough of the invention which, except for the tilting means, is also a top view of the embodiment of FIGS. 1 and 2.

Further referring to FIG. 4, and as seen in greater detail in FIG. 6, extending out from central cylindrical housing 12 are liquid introduction means in the form of pipe and flexible tube arrangements 40, 42, and 44, for introduction of liquids into the various turns or channels of the spiral trough 32, one for example for dispensing wash liquid, the second for dispensing a rustpreventive solution, and the third for dispensing a rinse solution, these dispensers in the form of pipe and flexible tube arrangements 40, 42, and 44 being supplied from a source (not shown) external of the machine by means of flexible hoses 46 extending up through central cylindrical housing 12 to the point of connection therewith, as shown in greater detail in FIG. 6. Also shown in FIGS. 4 and 6 is liquid level control means in the form of vacuum manifold 48 having radiating hollow arms 50, as shown four of such arms, extending therefrom, one of which arms is connected at its outer end with a connection to vacuum supply means 52, in turn connected with the vacuum generating mechanism external of the device and not shown. Flexible tubes 54 extend from arms 50 and, as shown, are curved so as to be practically horizontal at the ends thereof which rest on the bottom of the various turns or channels of trough 32 wherein located, thus being adapted to siphon from the channel bottom liquid at all levels which are deeper than the diameter of said flexible tube 54 for maintaining a predetermined liquid level in the respective turns or channels of the spiral trough where such fluid intakes in the form of flexible tubes 54 are located. Thus, if an amount of liquid in excess of that predetermined to be desirable in a particular low section of a selected turn or channel of spiral trough 32 should develop in such a low section, it will not be carried around the higher section of the turn of the trough and into the low section of the succeeding turn of the spiral trough 32 because of the liquid level control means already identified in the form of vacuum manifold 48, arms 50, connection to vacuum supply means 52, and flexible tubes 54 for liquid level control in the various turns of the spiral trough or chamber 32. In FIG. 4, arcuate arrow 56 is indicative of the approximate area of the spiral trough or chamber having liquid therein, which of course comprises the lower sections of the trough, i.e., those sections of the trough tilted downwardly by virtue of being opposite to the tilting mechanism 100 shown in FIGS. 3 and 4. The areas or sections of spiral trough or chamber 32 which will contain liquids in any selected channel for any given operation will vary depending upon the operation and type of operation being conducted, as well as with the size and quantity of material being treated and the speed at which the particular finishing operation is being carried out. In practice, it has been found suitable and advantageous to maintain the one side of the spiral trough approximately one inch higher than the opposite side of the spiral trough to maintain wash, rinse, and inhibitor solutions, or other liquid surface finishing media, in their respective channels adequately separated from each other and with a satisfactory stretch of dry channel therebetween. In FIG. 4, the highest point of the spiral trough would be at the approximate point of parts discharge or at least between the point of medium introduction and the point at which the finished parts are discharged.

As shown, workpieces 34 are introduced into spiral trough or chamber 32 at an internal turn thereof at 38, whereafter they are vibrated, by operation of the vibratory mechanism in a clockwise manner, counterclockwise and uphill along the internal channel of spiral trough 32.

As the workpieces progress, they progress in an uphill manner into a fluid wash introduced through pipe and tube arrangement 40. As they arrive at the uphill or raised portion of the trough not indicated by arrow 56, the workpieces 34 proceed, but fluid wash, although subject to the same vibrations, will not go uphill but will rather flow downhill to cover the area indicated by arcuate arrow 56.

As the workpieces 34 proceed around to the second cycle, lap, turn, or channel of spiral trough 32, a further fluid wash is introduced into the second channel of sprial trough 32 by fluid introduction means in the form of pipe and tube arrangement 42.

The foregoing procedure is repeated in the third channel, which as shown is a dry channel, with no fluid introduction, but with flexible tubes 54 siphoning off any excess fluid in the wet section which may exist in that channel of the spiral trough 32 by means of the vacuum backing up the fluid-level control system.

In the fourth channel, solvent or other fluid may be introduced through pipe and tube arrangement 44 and the procedure again repeated whereas, in the fifth channel, a rust inhibitor may be introduced by hand or by other means, such as a further pipe and tube with suitable connections just like the already-described fluid introduction elements 40, 42, and 44.

In the sixth channel, a solid drying material such as cobmeal 58, made from corn cobs but of the consistency of small breakfastfood flakes, is shown as employed for polishing and removing moisture from the workpieces 34. To maintain the drying medium 58 in dry condition, drying and recycling means may be provided. As illustrated, cobmeal 58 is introduced into an outer channel of spiral trough or chamber 32 by means of chute 59. After making its turn or turns around helical trough 32 and, as shown, preferably also somewhat ahead of workpiece exit chute 66, it is removed so that workpieces 34 can exit completely free of the drying medium 58. For this purpose vacuum pickup 64 is provided, preferably and as shown ahead of exit tube or chute 66 for exit of finished workpieces from trough 32, vacuum pickup 64 conveying the drying medium 58 via cyclone separator 66 and introduction chute 59, which passes under a heater to remove the last traces of moisture, to an outer turn of spiral trough 32 for reuse in the process. When the drying medium is extremely light and fluffy, as in the case of cobmeal 58, a thin barrier strip 62 may advantageously be provided between the last turns of spiral trough 32 to contain the drying medium within that portion of the trough 32 where it is needed, which is usually mainly from introduction chute 59 and then counterclockwise for at least a complete circle past chute 59 and somewhat beyond vacuum pickup 64. The portion of the strip 62 beyond vacuum pickup 64 and exit chute 66 is provided so that neither entrained nor freshly-introduced cobmeal 58 exits out exit chute 66 together with workpieces 34 and the approximate usual location of the drying medium 38 in the outer channels of spiral trough 32 is illustrated for a better understanding thereof by stippling in FIG. 4.

Figure 7:
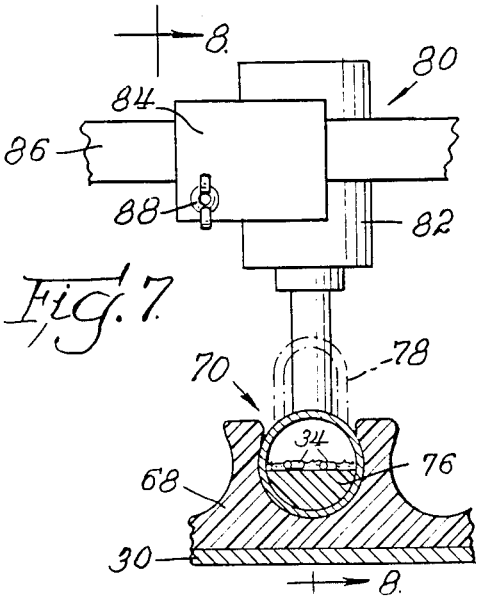
FIG. 7 is detail view of a dam device shown in FIG. 4, viewed from the front or rear thereof, with the dam device and spiral trough shown in section.
Figure 8:
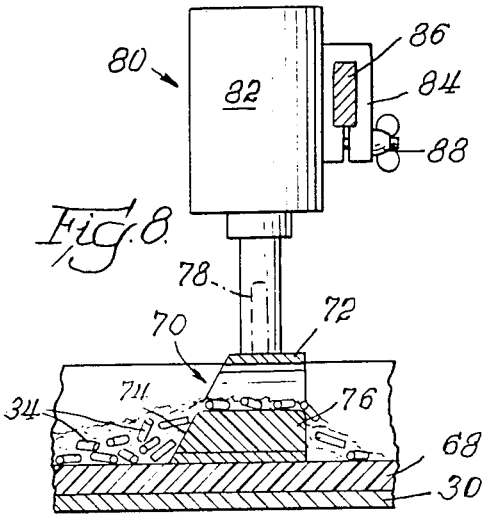
FIG. 8 is a detail view of the dam device of FIG. 7, partially in section, taken along line 8—8 of FIG. 7.
Figure 5:
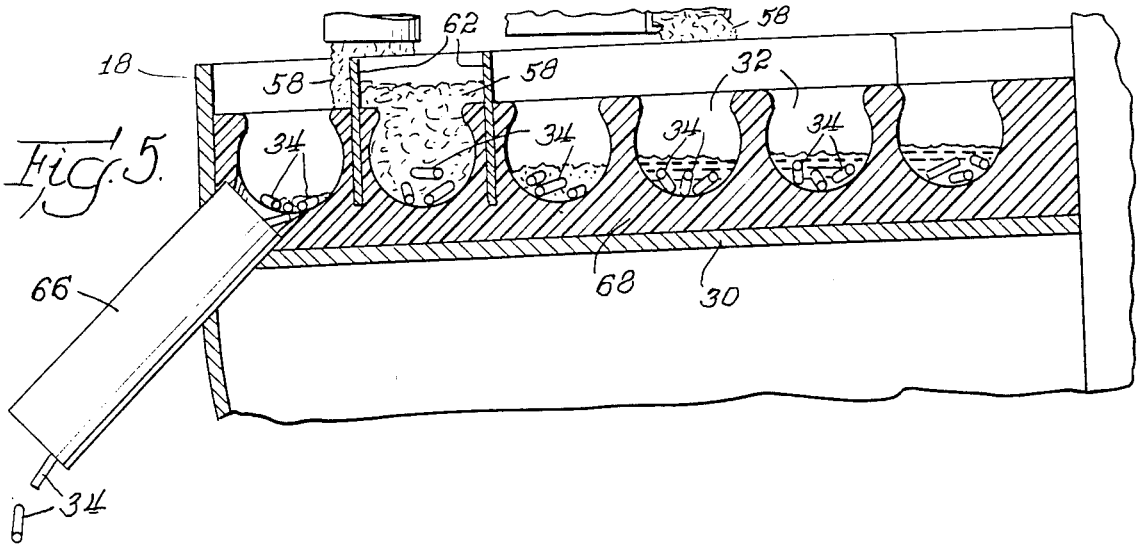
FIG. 5 is a section taken along line 5—5 of FIG. 4.

In the case of small runs or when it is desired that workpieces 34 be maintained in one or more channels or portions of spiral trough 32 for an extended period of time, retarding means or dam 70, as detailed in FIGS. 7 and 8, may be employed. As shown, such retarding means or dam comprises a short length of tubing 72 having an inclined leading edge 74 and partially filled with a resilient material such as polyurethane or other elastomer 76. Such retarding means or dam 70 may be inserted where desired by hand and removed by hand, if desired, as by employing gripping means in the form of loop 78 welded or otherwise secured thereto and shown in FIGS. 7 and 8 in phantom lines. Alternatively, as shown in FIGS. 7 and 8, retarding means or dam 70 may be inserted and/or removed by mechanical insertion and withdrawal means 80, comprising a hydraulic or pneumatic cylinder or solenoid 82, shown in FIG. 4 and detailed in FIGS. 7 and 8. Associated with said mechanical means 80 is mounting means for variable placement in and removal of retarding means or dam 70 in selected channels of spiral trough 32, as shown comprising clamping means 84 attached to cylinder or solenoid 82 and slidable on bar 86, which is in turn mounted on housing 12, with securing means in the form of a wingnut 88 and cooperating threaded screw provided for securing cylinder or solenoid 82, with attached retarding means or dam 70 at variable positions laterally from housing 12 and accordingly in different channels of spiral trough 32 as may be desired. Such retarding means or dam can frequently be of value also for assisting with the maintenance of the liquid or solid finishing media level in a particular channel or channels at a desired or predetermined or necessary level, as will immediately be apparent to one skilled in the art, although the dwell time of workpieces and/or finishing medium in the trough or in a particular channel thereof may also be controlled and/or varied from stage to stage or run to run controlling the precession time thereof in or about the trough or a particular channel thereof by varying the force factor of the vibratory means, as already stated and as well known in the art from U.S. Pat. No. 4,461,122 and others.

Slanting or tilting means 26 for slanting or tilting spiral trough 32, as shown in FIGS. 1 and 2, comprises a two-piece stand in turn comprising a base 90 and slantable or tiltable subbase 92 joined to base 90 by a heavy hinge arrangement 94, controlled at the side opposite said hinge by crank and screw adjustment 96 threaded through a nut held in swivel 98 mounted on subbase 92 itself or, as shown, on an arm attached thereto.

Slanting or tilting means as shown in FIGS. 3 and 4 comprises hydraulic or pneumatic cylinder 100 for raising and/or lowering spring 22 resiliently supporting chamber or bowl 18, it being understood that more than one such slanting means may be provided at different points about the circumference of the ring, tub, chamber or bowl 18 so that different points about the circumference of the spiral trough 32 may be made the highest point of the slanted trough, which has the obvious advantage that, if a single machine and trough is to be employed for the finishing of different workpieces which require different conditions, the necessary adjustments may be readily effected. FIG. 3 shows attachment and use of the spiral trough 32 to and in a pre-existing type of finishing machine structure, in this case within the bowl thereof, the type of finishing machine structure depicted in FIG. 3, aside from the aspects thereof provided by the present invention, being of the nature of a Spiratron TM ST-12 or ST-20 model.

Figure 9:
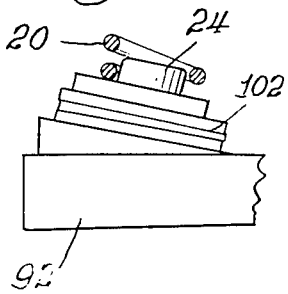
FIG. 9 is a detail view of a wedge or shim structure employed according to certain embodiments of the invention.

A slanting or tilting means 102, as shown in FIG. 9, is in the form of a wedge or shim, this type of slanting or tilting means being especially adaptable to situations where the same finishing machine is to be consistently employed for the finishing of the same type of workpiece or where conditions are to be maintained for other reasons so that slant or tilt adjustment is not required. Means 102 may readily replace means 100 in a pre-existing type of finishing machine structure such as that of FIG. 3.

A further manner of effecting the desired slant or tilt in spiral trough 32, not shown in the drawings, is simply by mounting the same at an angle within or atop ring, tub, bowl or chamber 18 and maintaining a horizontal resilient mounting of the said ring, tub, chamber or bowl proper. For certain embodiments, this has the advantage that the spiral trough 32 with supporting plate 30, as shown in FIG. 2, may simply be mounted at an angle within or atop an existing vibratory finishing chamber or bowl, at the desired angle with respect to the horizontal, thus obviating the necessity in such case of providing adjustable or fixed slanting or tilting means in the supporting structure. Still alternatively, the entire finishing machine may be tipped or tilted using a shim or wedge such as 102 at a selected point below its base 90.

Although the spiral trough 32, as shown, is constructed of elastomeric material such as polyurethane elastomer or the like, and as shown is molded into an annular block of polyurethane or other resilient elastomer 68, it will be apparent to one skilled in the art that the spiral trough 32 can be preformed from metal or other suitable rigid material and merely precoated, if desired, with a lining of polyurethane or other resilient elastomeric material 68, as is now conventional in the lining of finishing machine chambers according to the skill of the art.

It will also be apparent that, although as shown the tilt or slant of the spiral trough 32 does not provide the lowest point of the spiral trough directly opposite the point of introduction or exit for workpieces 34, it will be and frequently is desirable to so locate the spiral trough 32 with respect to the horizontal that the lowest portion and lowest areas thereof are essentially directly across from the point of introduction and/or egress of parts 34 from the trough and from the machine. In this manner, even without liquid control means, it presents no problem to maintain fluid in the lower channels of the spiral trough while at the same time maintaining the higher areas and channels of the spiral trough completely free of fluid, if desired.

Moreover, it will be apparent to one skilled in the art that the number of turns or channels provided in side-by-side relation in the spiral trough may be varied widely, from only a few up to numerous, as shown (FIG. 4) six turns or channels being provided in the spiral trough 32, and even a single channel or turn may be employed in or for a particular process application. The exact number of channels will depend upon the number of operations desired to be carried out in the spiral trough of the finishing machine and the exact type of operation to be conducted therein. For four separate operations, a minimum of four turns of the spiral trough is desirable, for example, whereas for six separate operations, at least six turns of the spiral trough will be the usual. However, in practice, it is frequently desirable to provide more turns or channels of the spiral trough 32 than required for the number of operations to be conducted therein and in the finishing machine comprising the same, leaving a full turn of the spiral trough vacant or devoid of fluid or whatever other finishing material may be employed therein, to ensure that, in the following turn of spiral trough 32, the treatment medium employed in the preceding turn of the spiral trough will be removed as the workpieces tumble about the turn of the trough left empty and usually dry. In this manner, for example, employing a spiral trough 32 with six complete turns, the inner turn may be filled at its lower portion with treatment fluid A, the second turn may be left vacant, the third turn at its lower portion may be filled with fluid treatment medium B, the fourth turn at its lower portion may be filled with fluid treatment medium C, the fifth turn may be left vacant, and the sixth turn up to near the point of egress of the workpieces from the finishing machine may be filled with a final drying and polishing medium such as the cobmeal 58 shown in the drawings. Innumerable variations are available as may be considered necessary or desirable by the operator.

It will also be apparent to one skilled in the art that although, as shown in the drawings, the point of introduction of unfinished workpieces 34 into the finishing machine is at an inner turn of the spiral trough and the egress or exit for finished workpieces at an outer turn of the spiral trough, the workpieces traveling counterclockwise in the device as shown in FIG. 4, it is a simple matter for one skilled in the art to simply reverse the direction of rotation of the vibratory means 14 within the central cylindrical column 12, thereby reversing the flow of materials in the spiral trough 32 to a clockwise direction, the flow of materials in spiral trough 32 always being, as will readily be recognized by one skilled in the art, in the direction opposite to the direction of rotation of the vibratory means 14. In such an arrangement, it is a simple matter to reverse the introduction of parts to an outer turn of spiral trough 32 and to provide exit means at an inner turn of spiral trough 32, with appropriate reversal of parts for collection of the finished parts and introduction of the parts to be finished at sides of the spiral trough opposite to those shown in the drawing. It will also be apparent to one skilled in the art that, in any particular arrangement of the spiral trough 32 with a particular defined number of turns, the introducion of parts may be made at any desired turn of the spiral trough 32 and need not be made at the furthermost inner turn of the trough or at the outermost turn of the trough as, with minor transposition or change in the location of parts, the introduction of parts to be finished can be made at any particular turn of the spiral trough so as to employ any selected number of turns of the trough for the preselected finishing operation.

METHOD

In operation, the spiral trough 32 is resiliently supported at an angle with the horizontal by any one of the various means previously described. Preferably while the trough is vibrating, workpieces 34 are introduced into inner turn or channel 1 thereof by means of workpiece entry chute 36. As introduced, the parts are contaminated with oil, grease, or other surface contaminants, or with burrs, flashings, or like surface imperfections, and are in need of surface cleaning, polishing, and/or finishing. Solutions or liquids introduced by hoses 46 from external of the finishing device enter the respective channels or turns of trough 32 by means of fluid introduction heads 40, 42, and 44, as shown respectively introducing fluids into channels 1, 2, and 4 of the spiral trough. Channels 3 and 5 are left vacant for drainage back from the elevated portion of the spiral trough to the lower section or area of the spiral trough, whereby the portion of the spiral trough identified by the arc 56 is permitted to contain and retain fluid, by means of back-drainage to the lower level, by means of vacant channels 3 and 5, and by means of fluid level controls 54. Thus, through fluid introduction means 40 a wash solution may be introduced, which drains back to the area of channel 1 indicated by the arc 56 and is maintained at that level if necessary by fluid control means 54. Into channel 2, by means of fluid introduction means 42, is introduced a rinse fluid for removal of the fluid first employed in channel 1. Thus the fluid introduced into channel 1 may be a solvent and the fluid introducted in channel 2 may be an aqueous detergent solution or another type of solvent-removing fluid. In any event, the fluid from channel 2 collects in channel 2 in the area indicated by arc 56 and any residual fluid carried over by the workpieces 34 entering channel 3 from channel 2 drains off in the dry and otherwise vacant channel 3, again collecting in the lower portion of channel 3 in the area indicated by arc 56 if any remains. In both channels 2 and 3, if the fluid introduced is deemed excessive, liquid level control means 54 in channels 2 and 3 may be employed for removal of excess liquid and maintenance of the desired level. In channel 4 an inhibitor solution may be introduced by means of fluid introduction head 44, and this inhibitor solution again collects in the lower portion of spiral trough 32, that is, in the portion of channel 4 thereof indicated by arc 56. Any fluid carried over by the parts entering channel 5 from channel 4 will likewise drain to the lower portion of channel 5 into the area indicated by arc 56. In the event fluid collected in these areas of channels 4 and 5, respectively, is deemed to be excessive or rises to a height at which the section or portion of a channel opposite to a wet channel portion or section is not maintained in what is deemed to be a satisfactorily dry condition, or to ensure that the various liquid surface finishing media employed in their respective channels do not mix with each other, liquid level control means 54 in the respective channels may be activated to ensure that the liquid level is at all times and in all channels maintained at a predetermined and acceptable height. Obviously, the liquid level control means for the various channels may be made independent of each other, instead of acting collectively through a manifold, if desired. Moreover, it goes without saying that mixtures of solid an/or fluid finishing media, or spraying of fluid finishing medium into or upon solid finishing media, or the like, may be employed where such practices have no adverse effect, according to the skill of the art.

In channel 6 is maintained a drying and polishing medium, as shown cobmeal 58, which in FIG. 4 is shown to circulate continuously about the outer turn of trough 32, that is, in channel 6 thereof. Suitable tilting or slanting of the spiral trough 32 with respect to the horizontal is effected by means of slanting or tilting mechanism 28 or 100, as shown in FIG. 4 by tilting mechanism 100. Workpieces entering into spiral trough 32 by means of entrance trough or chute 36, in the embodiment shown, enter into the innermost part of trough 32 at 38, whereupon they commence their vibratory journey about trough 32 in the various channels thereof, in channel 1 undergoing a treatment with wash solution in the area of arc 56 and emerging once again into a dry area in the opposite section of that channel of the spiral trough. Then, in channel 2, they are subjected to treatment with a rinse solution in the area of arc 56 and emerge again into a dry area at the opposite side of said channel. In channel 3, which is a vacant or dry channel, vibration of the parts or workpieces causes them to purge themselves of excess fluid acquired in the treatment within channel 2. Upon entry into channel 4, at the portion thereof identified by arc 56, the workpieces are again subjected to fluid treatment, this time by an inhibitor solution, and once again they emerge at the opposite side of the channel into an essentially dry area where, by vibration, the workpieces 34 again purge themselves of the fluid treatment medium imparted thereto in the preceding channel, so that they have been effectively treated with at least three solutions each considered to be a liquid surface finishing medium. Then, upon entry into channel 6, they encounter the final drying, finishing, and polishing medium in the form of cobmeal 58. As shown in FIG. 4 and the rest of the drawings, the cobmeal medium is introduced into the spiral trough 32 just a bit ahead of the commencement of channel 6 thereof, since the workpieces are at this point essentially dry and ready for such further surface treatment. Along with the cobmeal 58, the workpieces 34 then progress further into and along channel 6, which as shown is the outer turn or channel of the spiral trough 32 which, with its support plate is mounted within or atop tub, ring, bowl, or chamber 18, and pass under cobmeal entrance chute 59 and under cobmeal vacuum pickup 64, from which point on the dried, polished, and finished workpieces 58 progress onwardly a short distance alone to the parts exit chute 66, from which they exit not only the trough 32 but also the finishing machine proper. If the solid finishing medium is not removed, as by a vacuum pickup, prior to egress from the trough and machine, the workpieces and finishing medium employed may be separated external of the machine by vacuum pickup means, a magnetic separator, or a shaking screen separator, all according to the skill of the art, and of course either or both of the finished workpieces and the finishing medium may be recycled back into the process if desired. Barrier strip 62 as shown separates the fifth and sixth channels and extends part way between the fifth and fourth channels for maintaining the light and fluffy cobmeal separate from the other channels of spiral trough 32.

A vacuum is imparted to the fluid control means 54 through vacuum manifold 48 and radiating arms 50 from vacuum supply means connection 52 to the extent necessary for maintaining the liquid level in the various lower portions of the respective fluid-containing channels at an acceptable level, and is actuated either continuously or only when and to the extent necessary. When it is desired to slow down the progress of workpieces about the spiral trough 32, the retarding means or dam 70, or a plurality of the same, may be inserted into the selected channel or channels of trough 32 either by hand or by employing mechanical retraction and lowering means 80 including a hydraulic or pneumatic cylinder or solenoid 82 as shown in FIG. 4 and in detail in FIGS. 7 and 8.

Thus, after making the predetermined number of passes or cycles around the channels of spiral trough 32, the parts or workpieces 58 have been subjected to the preselected surface treating solutions or media and to preselected solid drying, finishing, and/or polishing media and emerge from the exit chute 66 of the finishing machine 10 with a clean, dry, and polished surface and suitable for immediate use for their intended purpose.

The method or process of the invention can obviously be conducted in a batchwise, intermittent, or continuous manner, with batchwise, intermittent, or continuous introduction of workpieces to be finished, plus additional finishing media of whatever type and quantity as may be required, plus recycling of the same to the extent desired, with corresponding batchwise, intermittent, or continuous exit of finished workpieces.

It will be apparent to one skilled in the art that, instead of introducing fluid finishing media into channels 1, 2, and 4 of spiral trough 32, leaving vacant or dry channels 3 and 5, the structure and sequence may be varied. For example, the fluid finishing media may be introduced into channels 1, 3, and 5, leaving channels 2 and 4 vacant or dry for drying of workpieces and/or drainback collection of residual fluid in the lower portion of these vacant channels in the area designated by arc 56, thereby ensuring the maintenance of dry areas in all of the respective channels at the opposite side of the spiral trough 32, that is, in the approximate areas thereof not designated by arc 56 and opposite thereto. With the proper selection of fluid finishing media, quantities thereof, and tilt or slant of spiral trough 32 from the horizontal, for many operations and for many constructions a fluid control means 54 may not be required. For other applications, such fluid control means 54 may not only be considered highly desirable but even essential, depending upon the operator and the precise degree of control maintainable over the slant or tilt of spiral trough 32 by the operator as well as the precise degree of control maintainable over the quantities of fluid finishing media introduced into the operation by the operator, as will be well understood by one skilled in the art.

On the other hand, it should be apparent that the surface finishing medium provided in one or more inner channels or in the innermost channel may be a solid surface finishing medium, maintained at a suitable level in the lower sections thereof but not in the upper sections thereof, and that liquid surface finishing media may be employed in one or more outer or alternate channels of the spiral trough, or that one of liquid and solid surface finishing media may be omitted from the process, without however varying the process or procedure in any essential manner.

As previously stated, it is apparent that the number of channels, the sequence of finishing operations, and the type of finishing medium and whether solid or liquid employed in each channel, and the precise arrangement of the parts or even reversal thereof to introduce workpieces at an outer channel rather than at an inner channel, and the provision of an exit chute or other means of egress for finished workpieces at an inner rather than outer channel of the vibratory spiral trough, are all matters of choice depending upon the type of structure to be employed, whether original equipment or whether a refitted finishing machine with a finishing chamber or bowl already in place, such as a Spiratron TM ST-12 or 20 or ER-10 or 20, and the exact type of workpiece to be treated and the precise treatment desired, and that each or all of these changes in structure or parameters may be varied by the manufacturer or by the operator as a matter of preference although, for the purpose of surface finishing of small parts such as roller bearings or the like, the structure shown in the drawings and the operation described in the foregoing, including even the recycling and drying of the cobmeal finishing medium employed in the final channel of the finishing trough, do represent a preferred embodiment of the invention in both its product and its process aspects.

FURTHER DETAILED DESCRIPTION OF THE OPERATION OF THE METHOD AND APPARATUS OF THE INVENTION

The following example is given by illustration only, but is not to be construed as limiting:

EXAMPLE

In a vibratory finishing machine, constructed essentially in accord with FIGS. 1 through 6, a spiral trough having an arcuate bottom and in accord with FIG. 4 is fitted and secured. In several applications, the spiral trough is secured upon or within the finishing chamber of an existing Spiratron TM ST 12 or ST S20 TM vibratory finishing machine, the necessary slant or tilt being provided in any one of various ways already disclosed. The spiral trough is constructed of mild low carbon steel and is used in unlined condition or lined with elastomer (Conethane TU-79 TM polyurethane). In another embodiment, the spiral trough is itself formed of Conethane TU-79 TM elastomer and mounted upon mounting means in the form of an annular sheet of mild low carbon steel. The advantages of an elastomer-lined trough over the unlined trough are apparent and the advantages of a trough constructed entirely of elastomer are even more apparent during operation of the device.

The vibratory mechanism, mounted inside the cylindrical central column, comprises two eccentric weights mounted on a central shaft, driven by a universal motor, the weights beng set out of phase with each other 90° for precession of workpieces about the spiral finishing trough of the invention. The vibration frequency is maintained between 800 and 2300 revolutions per minute, with the amplitude varying between 0.5 mm and 10 mm.

The spiral trough of the invention is 40 to 144 inches in diameter, the depth of each channels is two inches, the width of each channel is two inches, and each channel has an arcuate bottom which is or approaches semicylindrical in cross section.

The spiral trough is maintained at an angle with the horizontal, varying from a fraction of a degree to ten degrees, and is usually approximately one inch higher at its higher side than at its lower side.

The fluid finishing medium introduction means is as shown in FIG. 4, with the exception that the introduction means is present in channel 1 for the introduction of water into the trough, in channel 3 for the introduction of aqueous detergent cleaning solution into the trough, and in channel 5 for the introduction of rust inhibitor solution into channel 5 of the spiral trough of the invention. Intermediate channels 2 and 4 are left vacant with no fluid or solid finishing medium therein. Channel 6 and the last portion of channel 5, as shown in FIG. 4, are loaded with cobmeal, a well-known solid particulate finishing and drying medium. The solid particulate finishing medium is vacuum suctioned from the outer periphery of the spiral finishing trough and returned for recycling into the process after being heated to about 140° F. by a solid block heater maintained at 6000 watts and at a temperature of approximately 400° F., the cobmeal passing underneath the heater on its return into the process.

In some operations, small plastic or ceramic cones or triangles replace the cobmeal. In these runs, the solid particulate finishing media is not vacuum removed from the spiral finishing trough of the invention, but is rather allowed to pass out of the finishing machine along with the finished workpieces and the vacuum removal thereof is effected outside the machine. Alternatively, solid particulate finishing medium is removed from the finished parts on a shaking screen or, when magnetic parts are being finished, the separation is effected by using a magnetic separator. In another run, a bleaching solution is present in one of vacant channels 2 and 4 for the purpose of lightening the surface appearance of a previously-burnished workpiece.

With the setting employed for the vibratory mechanism, the time cycle of the treatment from unfinished parts in to finished parts out is varied between two and twenty minutes. The parts are introduced into the innermost channel, channel 1 as shown in FIG. 4, and work their way outwardly under the influence of the vibrogyratory action imparted to the trough by the vibratory mechanism previously described. The parts are introduced into the parts introduction means, in the form of a chute, from a pan or conveyor, in conventional manner. The parts finished are varied considerably in their nature, size, and configuration, from ball bearings and roller bearings of variable dimensions to pins, nuts, bolts, screws, hinges, brackets, washers, coins, and the like, of steel, brass, titanium, magnesium, various alloys, plastics, and the like.

One particular type of workpiece with regard to which the finishing machine, finishing trough, and method of the present invention is found especially suitable is stainless steel roller bearings between about 0.02 and 0.3 inches in diameter, having a length between about 0.04 and two inches. When introduced into the process of the invention, these parts normally contain oil, residual grinding materials, and the usual surface dirt, which are all effectively and completely removed in the apparatus and according to the method of the invention to give a clean, highly polished, and dry workpiece ready for immediate application as an essential part of an assembled roller bearing mechanism.

For other applications involving somewhat larger parts and/or more complex structures and/or configurations, a suitable width and depth of each channel in the vibratory finishing trough of the invention is four inches with the same diameter of sixty inches for the total diameter of the spiral finishing trough, although it is obvious that finishing troughs having a greater or lesser diameter and a greater or lesser depth of channel and a greater and even smaller width of channel may be employed to advantage, depending only upon the type of finishing operation involved and the type, kind, and size of the workpiece being finished.

The same or similar advantageous results are obtained with the employment of numerous other finishing media and for the surface finishing of innumerable other and different types and kinds of workpieces, including the types and kinds presently being finished less efficiently, economically, and rapidly according to present-day skill of the art.

THE ELASTOMER

Any suitable and usual elastomer can be employed in producing the spiral finishing trough or trough lining which is required and/or preferred according to certain embodiments of the invention. The term "elastomer" as used herein is to be understood to be or comprise any of numerous natural or synthetic elastomers which stretch under tension, have a high tensile strength, retract rapidly, and essentially recover their original dimensions. Examples include natural rubber, homopolymers such as polychlorobutadiene, polybutadiene, polyisoprene, copolymers such as styrenebutadiene rubber, butyl rubber, nitrile rubber, ethylenepropylene copolymers, fluorine elastomers, and polyacrylates, polycondensation products such as polyurethanes, neoprene, ABS rubber, PVC rubber, silicone rubber, and polysulfide rubber, as well as chemical conversions of high polymers such as halogen-substituted rubbers. Shore A hardness between fifty (50) and one hundred (100), preferably about sixty-five (65) to ninety (90), is usually preferred. When the elastomer is of the polyurethane types, it may be prepared by the prepolymer method or by mixing the ingredients concurrently or simultaneously through several nozzles in a so-called "one-shot" application involving the instantaneous reaction of two or three components. Other details of the elastomer, and elastomeric lining, and its formation according to conventional practice of the art may be found in columns 9 and 10 of U.S. Pat. No. 4,480,411.

The selected elastomer may advantageously be employed in a pourable form which upon setting, in the presence of a mold, results in any desired configuration of trough or trough lining which may be advantageous or desirable. The ADIPRENE TM family of urethane elastomers produced by DuPont, and CONATHANE TM two-component polyurethane casting systems, produced by Conap, Inc., Olean, N.Y., are particularly suitable for use in accord with the present invention. The CONATHANE TU-79 TM system is particularly adaptable to the production of a finishing trough or trough linings inasmuch as it attains a Shore A hardness of 80±5 and has excellent tensile strength and compression characteristics. Moreover, upon admixture of the two parts of the two-part system, the initial mixed viscosity at 25° C. or 77° F. is only 4,000 cps, thus making it pourable into almost any configuration for the production of a trough or trough lining according to the invention, whether into forms for the trough itself, or in forms to be subsequently bonded to the trough wall or to a release agent on said wall, or whether poured directly into the trough, thereby to become self-bonding to the walls thereof or to a thermally-activatable release agent on the interior surface thereof upon curing. With a pot-life of 35 to 40 minutes at 25° C. and the ability to cure at room or elevated temperatures, this system has been found highly satisfactory. The cure of one hour at 25° C. plus 16 hours at 80° C. is convenient and, alternatively, the applied elastomer can be cured by allowing it to stand for seven (7) days or less at 25° C. If a mold is employed, as is usually the case and which is greatly preferred in today's practice, mold releases of various types can if desired also be employed to obtain rapid, clean, and convenient release from the mold, as is now conventional in the art. The elastomeric trough or trough lining is preferably bonded to the support means or trough walls or to a thermally-activatable release agent inside of the walls by pouring in place in fluid or semifluid condition and allowing to cure in place, with possible application of heat and use of curing agents if desired, or it may as previously mentioned be preformed and bonded to the support means or interior of the finishing trough or to a thermally-activatable release agent inside of the trough directly, with or without the application of external heat and/or further adhesive. The insertion of a unitary mold into a surrounding cavity or void and the pouring of the elastomer into the void around said mold and allowing it to cure is a preferred embodiment according to the present invention.

FINISHING MACHINES

Aside from the particular structures shown and described, the spiral trough of the invention, and especially when mounted upon support means such as an annular or other supporting plate, may be used in or upon or in connection with any original equipment or pre-existing finishing machine structure or the like, especially a vibrogyratory finishing machine, such as those used for grinding, deburring, descaling, edge-breaking, polishing, bright-honing, burnishing, and any other surface finishing of parts or workpieces, which may and generally do comprise wood, metal, ceramic, glass, or the like, especially as an insert or addition thereto or therefor. Reference is made to U.S. Pat. No. 4,162,900, representatively illustrating a vibratory finishing machine embodying a finishing chamber, as well as U.S. Pat. Nos. 3,161,993; 3,981,693; 3,990,188; 4,012,869; 4,022,012; 4,172,339; 4,177,608; 4,307,544; 4,329,817, and U.S. Pat. No. RE 37,084, and U.S. Pat. No. 4,480,411, for various other types of finishing machines in, upon, or with the major vibratory structures of which the spiral trough of the present invention is adapted to be and may be advantageously employed or embodied, as may be desired by the operator, always in a somewhat slanted or tilted position with respect to the horizontal.

FINISHING MEDIA

By the term "finishing media" as used herein, or its equivalent terms "finishing material" or "finishing medium", it is intended to include loose, comminuted, granular, or particulate finishing materials of the type presently employed in the trade and others of a similar nature. When liquid finishing materials or "compound" are employed, whether in conjunction with solid finishing material or otherwise, these are stated to be liquid or fluid. The terms first set forth in this paragraph are used generally and herein to designate such solid or liquid materials which are used to impart all types of finishes, including those improved finishes acquired with solvents, inhibitor solutions, aqueous washes, and with abrading materials as well as polishing materials and drying materials, "cleaning", "polishing", "burnishing", "drying", and so on being terms considered in their usual sense as species of "finishing". Such suitable finishing media include, inter alia, porcelain, ceramic, aluminum, steel, zinc, stainless steel, and granite chips, cobmeal, sawdust, and the like, all as well-known in the art, and in various sizes and configurations, also as well-known in the art, such configurations representatively being cones, bars, cylinders, squares, stars, flakes, crumbs, particles, dust, and the like.

CIRCULAR, ANNULAR, CYLINDRICAL, SPIRAL

When an essentially cylindrical tube is referred to herein, or an essentially circular plate or tub or chamber, or an essentially annular plate, or ring, or a spiral trough, it is intended to convey that the structure is essentially cylindrical, circular, annular, or spiral, but that it only need be such to the extent that the operativeness of the finishing trough and device produced therefrom or embodying the same is not seriously impaired. Obviously, for best results, completely circular chambers or plates, completely annular supporting plates or rings, completely cylindrical tubes for center columns, and a completely "spiral" trough are most highly desirable, so that the terms "circular", "cylindrical", "annular", or "spiral" can be most advantageously applied, but it is only necessary that the center column, the tube comprising the same, the supporting plates or rings, and the spiral trough be respectively generally cylindrical, circular, annular, or spiral, and not essential that these elements be such in any precise sense of the term. It is only necessary that they be generally circular, cylindrical, annular, or spiral, that is, that the spiral trough and the channels thereof be insufficiently cornered so as to prevent the free flow of finishing media and parts to be finished therein in and around the interior of the spiral trough comprising the finishing chamber. For example, a generally-annular or circular supporting plate or ring, as well as the generally cylindrical center column, and especially the inner and outer walls of the spiral trough, may have a decagonal, octagonal, hexagonal, or pentagonal configuration, or any other somewhat cornered configuration, when viewed from above, which does not detract from its generally-annular or circular or spiral nature or interfere with the flow of parts and media about the interior of the spiral trough finishing chamber. Although for purposes of ultimate convenience and operating efficiency a truly circular center column, annular plate or ring, and a truly spiral trough finishing chamber are preferred, other somewhat modified forms may be employed with equal or only somewhat reduced efficiency, as will be readily apparent to one skilled in the art.

SPIRAL

The term spiral, as used herein, is employed in its usual meaning as being the path of a point in a plane moving around an axis while continuously receding from it or winding around a center and gradually receding from it. The spiral trough and the individual channels thereof accordingly have usually their bottoms in what is essentially a single plane. The spiral is not helical in nature although, as explained elsewhere in detail, the spiral trough is tilted in operation. It does not, like a helix, advance to higher levels continuously through a series of cyclical movements about the axis of the spiral. Thus, to the extent that the spiral trough of the present invention is tilted, it partakes to a limited extent of the nature and characteristics of a helical trough, although separate and distinct therefrom, with its own particular advantages of a high side and a low side, with the high side being devoid of liquid or other finishing medium so as to provide a separation between different kinds and/or types of media employed at different stages of the device and process of the invention, and with the low side providing means for containment of the liquid or other finishing medium utilized in the method of the invention as the surface finishing medium of choice. The individual turns or channels of the spiral trough of the invention, as well as the spiral trough itself, form a ring or a series of rings, the rings not being closed or completely closed at their ends as in the case of the usual ring or annulus.

THE SPIRAL TROUGH

As previously stated, if desired, the spiral trough may advantageously be coated with or formed of polyurethane or other resilient elastomeric material, and its production is readily and conveniently effected by any of numerous means and in any of various manners. For example, a suitable circular or annular or doughnut-shaped supporting plate may be provided, along with sidewalls to retain poured elastomeric material while in the fluid state and before solidification thereof, and a section of rope, cable, or pipe impressed into the semi-solid elastomeric material before hardening to imprint therein the desired contours of the spiral channel. When operating in this manner, release material is advantageously applied to the rope, cable, or pipe employed for forming of the spiral channel, as is conventional in the art. A particularly advantageous material for formation of the spiral channel in such manner is polyvinylchloride pipe, having the desired dimensions and, when comnbined with conventional release material, this has been found to be a particularly satisfactory manner of forming the spiral trough. Another satisfactory procedure for the preparation of the spiral trough involves the preformation of a mold having the desired indentations therein for formation of the trough and then pouring the elastomeric material, for example, the polyurethane in semi-solid state, into contact with the preformed mold, with the indentations constituting the trough channels directed either upwardly or downwardly, as may be most advantageous according to the precise manner of operation being carried out. Further details concerning the type of elastomer employed for the spiral trough or for the lining thereof are provided in the foregoing.

It is thereby seen from the foregoing that the objects of the present invention have been accomplished and that a novel spiral trough, uniquely adapted to be the trough or chamber of a vibratory finishing machine, as well as a finishing machine comprising the same, and a method of finishing in such a novel spiral trough or chamber, have all been provided, and whereby all of the previously-mentioned advantages have been attained. It should be apparent that the device of the present invention may take the place of several finishing machines, since each lower channel of the spiral trough of the invention may take the place of a single vibratory finishing machine and each upper channel of the spiral trough of the invention may take the place of an unloader, storage means, and loading means for the next operation which, instead of being carried out in a separate finishing machine, is carried out in a successive channel or channels of the spiral trough of the present invention. No time is lost in operating according to the method of the invention or in using a device of the present invention in the unloading of one machine, or in transfer of partially-finished parts to another machine or into storage until the first machine is again emptied and readied for further employment with a different finishing material than first employed. As to the outermost portion of the trough or chamber of the present invention and finishing machines comprising the same, such portion may act only as a part of a separate finishing machine, and not as a storage or transfer means, when the next stage is the egress of finished parts from the spiral trough and out of the finishing machine comprising the same. This is usually the case for the channel or turn which is employed for solid finishing or drying, whether it be an internal turn or turns or an outside turn or turns, because of the fact that no liquid is ordinarily employed in such operation but rather a solid finishing, e.g., drying, medium such as cobmeal, so that when the partially finished parts go uphill in the tilted spiral trough of the invention and around the solid finishing, e.g. drying, portion of the trough, they are most frequently caused to exit from the trough and machine shortly thereafter.

Although the preferred embodiments of the invention have been illustrated in the accompanying drawings and described in the foregoing description, it is to be understood that the invention is not limited to the embodiments disclosed or to the exact details of operation or exact compounds, compositions, methods or procedures shown and described, since the invention is capable of numerous modifications, rearrangements, and substitutions of parts and elements and other equivalents, both metallurgical and mechanical, without departing from the spirit or scope of the invention, as will readily be apparent to one skilled in the art, so that the present invention is to be understood as being limited only by the full scope which can legally be accorded the appended claims.

I claim:

1. A vibratory finishing machine for the surface finishing of parts or workpieces comprising an essentially spiral trough, having a plurality of channels in side-by-side relationship, resiliently mounted for vibration and tilted with respect to the horizontal so as to provide a high side and a low side to said spiral trough.

2. The machine of claim 1, comprising means for introduction of unfinished parts into one channel of said spiral trough and means for exit of finished parts from another channel of said spiral trough.

3. The machine of claim 2, wherein said means for introducing unfinished parts is arranged to introduce unfinished parts into an interior channel of said spiral trough.

4. The machine of claim 3, wherein said means for exit of finished parts is arranged for exit of finished parts from an outside channel of said trough.

5. The machine of claim 1, comprising means for the introduction of liquid finishing medium into one or more channels of said spiral trough.

6. The machine of claim 5, comprising means for the introduction of liquid finishing medium into a plurality of channels of said spiral trough.

7. The machine of claim 1, comprising liquid level control means in one or more channels of said spiral trough for controlling the liquid level therein at the low side thereof.

8. The machine of claim 7, comprising a plurality of liquid level control means in a plurality of said channels of said spiral trough.

9. The machine of claim 1, comprising tilting means for tilting said spiral trough with respect to the horizontal.

10. The machine of claim 9, wherein said tilting means is fixed.

11. The machine of claim 9, wherein said tilting means is variable.

12. The machine of claim 1, wherein said spiral trough comprises resilient elastomeric material.

13. The machine of claim 12, wherein said spiral trough is constructed of resilient elastomeric material.

14. The machine of claim 1, comprising a barrier strip between adjacent channels of said spiral trough for isolation of the contents of one channel from the contents of the adjacent channel.

15. The machine of claim 1, comprising means for introducing solid particulate finishing medium into a channel of said spiral trough.

16. The machine of claim 15, comprising pickup means for removing solid particulate finishing medium from a channel of said spiral trough at a point in said spiral trough after the point at which it is introduced.

17. The machine of claim 16, comprising means for returning said medium to a channel of said spiral trough.

18. The machine of claim 17, including heating means for drying said medium before returning same to a channel of said spiral trough.

19. The machine of claim 1, comprising means for the introduction of one kind of finishing medium into one channel of said trough and means for the introduction of a different kind of finishing medium into a different channel of said trough.

20. The machine of claim 19, comprising means for the introduction of solid finishing medium into one channel of said trough and means for the introduction of liquid finishing medium into a different channel of said trough.

21. An essentially spiral trough, having a plurality of channels therein in side-by-side relationship mounted on support means, constituting a finishing chamber of a vibratory finishing machine by attachment to a resiliently-mounted vibratory structure thereof, said trough being at an angle with respect to the horizontal.

22. The trough of claim 21, comprising or constructed of resilient elastomeric material.

23. The trough of claim 21, mounted in, on, or to the said structure of said vibratory finishing machine.

24. The trough of claim 21, mounted to the existing finishing chamber of a finishing machine having a central cylindrical column and to the central cylindrical column thereof.

25. The trough of claim 24, wherein said spiral trough and said support means have a circular opening central thereof to essentially correspond with the central cylindrical column of said finishing machine.

26. The trough of claim 25, wherein said spiral trough support means is generally annular in nature and of dimensions essentially corresponding to the cylindrical center column of said finishing machine and to the existing finishing chamber thereof.

27. A method for vibratorily surface finishing a workpiece which comprises the steps of subjecting a workpiece to the action of a surface finishing medium in an essentially spiral troughlike finishing chamber, having a plurality of channels in side-by-side relationship, which is resiliently mounted for vibration at an angle with respect to the horizontal, thereby to provide lower and upper sections of said troughlike chamber and the channels thereof, comprising the steps of:

introducing a workpiece to be surface finished into at least one of said channels;

introducing a surface finishing medium into said channel, maintaining the medium level in said channel so that the lower section of said channel contains said medium, and so that the upper section of said channel is essentially free thereof, imparting vibrations to said channel to cause said workpiece to be surface finished by said surface finishing medium in said medium-containing lower section of said channel, and to cause said workpiece to progress upwardly into said upper section of said channel which does not contain surface finishing medium.

28. The method of claim 27 including the steps of:

introducing a second surface finishing medium into a second channel of said trough, maintaining the medium level in said channel so that the lower section of said channel contains said medium, and so that the upper section of said channel is essentially free thereof, vibratorily causing said workpiece to progress into the section of said second channel of said trough containing said second surface finishing medium, and imparting vibrations to said second channel to cause said workpiece to be surface finished by said second surface finishing medium and then to cause said workpiece to progress upwardly into said upper section of said second channel which does not contain surface finishing medium.

29. The method of claim 28, wherein one of said first and second finishing media is a liquid finishing medium.

30. The method of claim 28, wherein one of said first and second finishing media is a solid finishing medium.

31. The method of claim 29 wherein the other of said first and second surface finishing media is a solid surface finishing medium.

32. A method for vibratorily surface finishing a workpiece which comprises the steps of subjecting a workpiece to the action of a surface finishing medium in an essentially spiral trough finishing chamber having a plurality of channels in side-by-side relationship, which is resiliently mounted for vibration at an angle with respect to the horizontal, thereby to provide lower and upper portions of said trough and the channels thereof, comprising the steps of:

introducing a workpiece to be finished into at least one channel of said spiral trough, introducing a liquid surface finishing medium into at least that channel of said spiral trough, maintaining the liquid level in said channel of said trough so that the lower portion of said channel contains said liquid, and so that the upper portion of said channel is essentially free thereof, introducing a solid surface finishing medium into another channel of said spiral trough, imparting vibrations to said spiral trough to cause said workpiece to be surface finished by said liquid surface finishing medium in said liquid-containing lower portion of said channel, and to cause said workpiece to travel upwardly into an upper portion of sid channel which does not contain said liquid surface finishing medium, and to cause said workpiece then to progress into said channel of said spiral trough containing said solid surface finishing medium, and to cause said workpiece then to be surface finished by said solid surface finishing medium, and then recovering said surface-finished workpiece.

33. The method of claim 32 when conducted in a batchwise, intermittent, or continuous manner.

34. The method of claim 32, wherein a plurality of different liquid surface finishing media are introduced into a plurality of channels and said workpiece is subjected to vibratory action in the presence in each of said liquid surface finishing media.

35. The method of claim 34, wherein said workpiece is caused to be dried between exposures to said different liquid media by vibratorily causing said part to traverse the upper section of at least one channel.

36. The method of claim 34, comprising the step of controlling the liquid level in said channels so as to ensure an essentially dry section of said channels at upper portions thereof.

37. The method of claim 34, wherein different liquid surface finishing media are introduced into alternate channels and the intermediate channel is left dry, thereby to cause residual liquid to drain from said workpiece and maintain said different liquid surface finishing media as separate entities.

38. The method of claim 32, wherein solid particulate finishing material is introduced into said spiral trough, used in finishing a workpiece, and removed from said spiral trough and new or recycled solid particulate finishing material introduced into said spiral trough for continuing the process with fresh finishing material.

39. The method of claim 38, wherein solid finishing material removed from said process is subjected to heating to dry the same and is then recycled back into the process.

40. The method of claim 32, wherein the dwell time of a workpiece within a particular section or channel of the spiral trough is increased by retarding the forward movement or precession thereof in a particular channel or section thereof.

41. The method of claim 32, wherein workpieces are vibratorily subjected to solvent surface treatment, rinse surface treatment, and rust inhibitor treatment in selected channels of said spiral trough and are then subjected to surface drying and polishing with cobmeal in a further channel of said spiral trough, whereafter the cobmeal is vacuum removed from said workpieces and the cleaned, dried, and polished workpieces recovered.

42. The method of claim 32, wherein the liquid surface-finishing medium to which a workpiece is subjected at a lower portion of one channel of said spiral trough is removed by vibratorily causing the workpiece to travel along the upper portion of said channel before being subjected to a further surface finishing medium in another channel.

43. The method of claim 34, wherein one liquid surface treating medium is removed from said workpiece before subjecting it to a second liquid surface treating medium by vibratorily causing the workpiece to travel along an intermediate channel between a channel containing a first liquid surface treating medium and a channel containing a second liquid surface treating medium which intermediate channel is essentially devoid of liquid surface treating medium.

44. The method of claim 32, wherein said solid surface finishing medium is contained in a channel of said trough which is the last channel in the direction of travel of said workpiece within said spiral trough.

45. A vibratory finishing machine for the surface finishing of workpieces comprising an essentially spiral trough, having a plurality of channels in side-by-side relationship and resiliently mounted for vibration, said trough being at an angle with respect to the horizontal.

46. A method for vibratorily surface finishing a workpiece which comprises the steps of subjecting a workpiece to the action of a surface finishing medium in a vibratory finishing machine comprising an essentially spiral trough, having a plurality of channels in side-by-side relationship and resiliently mounted for vibration at an angle with respect to the horizontal so as to have a downward section and an upward section, comprising the steps of:

introducing a workpiece to be surface finished into said spiral trough, introducing a surface finishing medium into said trough, and imparting vibrations to said trough to cause said workpiece to be surface finished by said surface finishing medium in a downward section of said spiral trough.

47. A method of claim 46 wherein a section of said spiral trough contains said finishing medium and another section of said spiral trough is essentially free of said finishing medium and including the step of causing said workpiece to progress from said section of said spiral trough which is essentially free of surface finishing medium into said section of said spiral trough which contains surface finishing medium.

48. The method of claim 27, 28, or 46, wherein at least one channel has a bottom which is essentially in a single plane.

49. The method of claim 27, 28, or 46, wherein a plurality of channels have bottoms which are essentially in a single plane.

* * * * *

UNITED STATES PATENT AND TRADEMARK OFFICE

CERTIFICATE OF CORRECTION

PATENT NO. : 4,693,037

DATED : September 15, 1987

INVENTOR(S) : Gary L. McNeil

It is certified that error appears in the above-identified patent and that said Letters Patent is hereby corrected as shown below:

Col. 1, line 20; "of" (second occurrence) should read -- or --

Col. 1, line 45; "section," (second occurrence) should read -- section thereof, --

Col. 10, line 1; after "run" (second occurrence) insert -- by --

Col. 15, line 50; "ST S20 TM" should read -- ST 20 TM --

Col. 15, line 67; "beng" should read -- being --

Col. 20, line 8; "have usually" should read -- usually have --

Col. 20, line 51; "comnbined" should read -- combined --

Col. 24, line 16; "sid" should read -- said --

Signed and Sealed this

Nineteenth Day of January, 1988

*Attest:*

*Attesting Officer*

DONALD J. QUIGG

*Commissioner of Patents and Trademarks*